US007635196B2

(12) United States Patent
Monahan

(10) Patent No.: US 7,635,196 B2
(45) Date of Patent: Dec. 22, 2009

(54) SOLAR MEMORIAL MARKER

(76) Inventor: Maurice J. Monahan, R.R. 3 Box KP25A, Harveys Lake, PA (US) 18618

( * ) Notice: Subject to any disclaimer, the term of this patent is extended or adjusted under 35 U.S.C. 154(b) by 104 days.

(21) Appl. No.: 11/725,943

(22) Filed: Mar. 19, 2007

(65) Prior Publication Data

US 2007/0217185 A1 Sep. 20, 2007

Related U.S. Application Data

(60) Provisional application No. 60/783,355, filed on Mar. 18, 2006.

(51) Int. Cl.
*F21L 4/00* (2006.01)

(52) U.S. Cl. ..... 362/183; 362/121; 362/397; 52/104

(58) Field of Classification Search ..... 362/183, 362/121, 252, 29, 30, 234, 253, 397, 351, 362/363, 808, 809; 52/103, 104; 40/612, 40/564

See application file for complete search history.

(56) References Cited

U.S. PATENT DOCUMENTS

| | | | | | |
|---|---|---|---|---|---|
| 1,614,703 | A * | 1/1927 | Wolfers | 362/121 |
| 4,304,076 | A * | 12/1981 | Splendora | 52/104 |
| 4,453,201 | A * | 6/1984 | Prouty | 362/121 |
| 5,255,170 | A * | 10/1993 | Plamp et al. | 362/183 |
| 5,404,343 | A * | 4/1995 | Boggio | 369/19 |
| 5,564,816 | A * | 10/1996 | Arcadia et al. | 362/183 |
| 5,704,103 | A * | 1/1998 | Crowley et al. | 27/1 |
| 5,913,616 | A * | 6/1999 | Galella | 40/542 |
| 5,924,784 | A | 7/1999 | Chliwnyj et al. | |
| 6,006,458 | A | 12/1999 | Weiss | |
| 6,082,880 | A * | 7/2000 | Nerlino et al. | 362/493 |
| 6,088,973 | A | 7/2000 | Weiss | |
| 6,132,054 | A * | 10/2000 | Rogers et al. | 362/86 |
| 6,173,539 | B1 | 1/2001 | Barnes | |
| 6,463,703 | B1 * | 10/2002 | Mattis | 52/103 |
| 6,467,222 | B2 | 10/2002 | Barnes | |
| 6,637,911 | B2 * | 10/2003 | Sittner | 362/253 |
| 6,741,042 | B1 * | 5/2004 | Tang | 315/291 |
| 6,951,408 | B2 * | 10/2005 | Stewart | 362/183 |
| 7,118,242 | B1 * | 10/2006 | Yulee | 362/121 |
| 7,125,138 | B2 * | 10/2006 | Reinmann | 362/183 |
| 7,241,023 | B1 * | 7/2007 | Carpenter | 362/183 |
| 2003/0221377 | A1 * | 12/2003 | Crawford et al. | 52/103 |
| 2004/0156133 | A1 * | 8/2004 | Vernon | 359/866 |

* cited by examiner

*Primary Examiner*—Gunyoung T Lee
*Assistant Examiner*—Sandra L O'Shea
(74) *Attorney, Agent, or Firm*—James Ray & Assoc.

(57) ABSTRACT

An illuminated gravesite marker assembly including a squat opaque base having disposed on the bottom face an attachment means adaptable to removably mounting on smooth surfaces, electrical circuitry electrically connected to at least one rechargeable battery for powering at least one low voltage light bulb, wherein at least one rechargeable battery is removably disposed within the squat opaque base, a translucent hollow form affixed atop the base and housing at least one low voltage light bulb, and on top, at least one photovoltaic cell being electrically connected to the electrical circuitry.

Also disclosed, is a solar illuminated gravesite marker assembly for pet cemeteries attachable to either a ground stake or flat surface.

6 Claims, 4 Drawing Sheets

SOLAR MEMORIAL MARKER

CROSS REFERENCE TO RELATED APPLICATION

This patent application is related to and claims priority from U.S. Provisional Patent Application Ser. No. 60/783,355 filed Mar. 18, 2006.

FIELD OF THE INVENTION

The present invention relates, in general, to gravesite marking devices and, more particularly, this invention relates to gravesite marking devices illuminated at night.

BACKGROUND OF THE INVENTION

Prior to the conception and development of the present invention, people have for centuries been marking the gravesites of deceased loved ones with markers such as flowers, crosses, or flags. Those visiting at dusk or after dark have probably noted how it would be desirable to have something illuminated at their loved one's burial site to make it easier to locate the desired grave and to see while walking in that vicinity. In U.S. Pat. No. 5,564,816, Arcadia discloses an illuminated memorial consisting of a hollow structure, such as a metal cross, with a light means and a rechargeable battery disposed within the structure. A photovoltaic source is mounted on near the top for the purpose of recharging the battery during the day, and a mounting means for attachment to a tombstone is located at the bottom.

In U.S. Pat. No. 6,132,054, Rogers teaches an assembly for attaching a pair of electric candles to the top of a headstone and providing a power source built into the base. Sittner in U.S. Pat. No. 6,637,911 discloses an assembly similar to that of Rogers with the notable difference that the illuminated form can be changed from a candle to other forms pertinent to a particular season or occasion. U.S. Pat. No. 7,033,045 discloses a solar powered illuminated vase for gravesite marking. All of the above appear to be specific for attachment to an upright grave marker. The current trend in cemeteries is toward mostly, if not only, ground-flush burial memorials, typically a marble slab with bronze plaques attached thereto. This makes it easier for groundskeepers to mow, but more difficult for those still living to find the gravesites of their loved one.

SUMMARY OF THE INVENTION

In a first aspect, the present invention provides an illuminated gravesite marker assembly including a squat opaque base having disposed on the bottom face an attachment means adaptable to removably mounting on smooth surfaces, electrical circuitry electrically connected to at least one rechargeable battery for powering at least one low voltage light bulb, wherein at least one rechargeable battery is removably disposed within the squat opaque base, a translucent hollow form affixed atop the base and housing at least one low voltage light bulb, and on top, at least one photovoltaic cell being electrically connected to the electrical circuitry.

A second aspect of the invention is an attachment means for mounting an illuminated gravesite marker assembly on one of a ground stake, an upright burial memorial, and a ground-flush burial memorial.

OBJECTS OF THE INVENTION

It is, therefore, one of the primary objects of the present invention to provide an illuminated gravesite marker as an aid for visitors coming to a loved one's burial site in periods of low lighting.

Another object of the present invention is to provide a low-maintenance, self-recharging illuminated marker.

Still another object of the present invention is to provide a remembrance of the deceased love for a favorite pet or class of animals by having a resemblance of that being the illuminated form.

Yet another object of the present invention is to provide a solar powered illuminated marker for a pet's gravesite.

In addition to the various objects and advantages of the present invention described with some degree of specificity above it should be obvious that additional objects and advantages of the present invention will become more readily apparent to those persons who are skilled in the relevant art from the following more detailed description of the invention, particularly, when such description is taken in conjunction with the attached drawing figures and with the appended claims.

Figure 1:
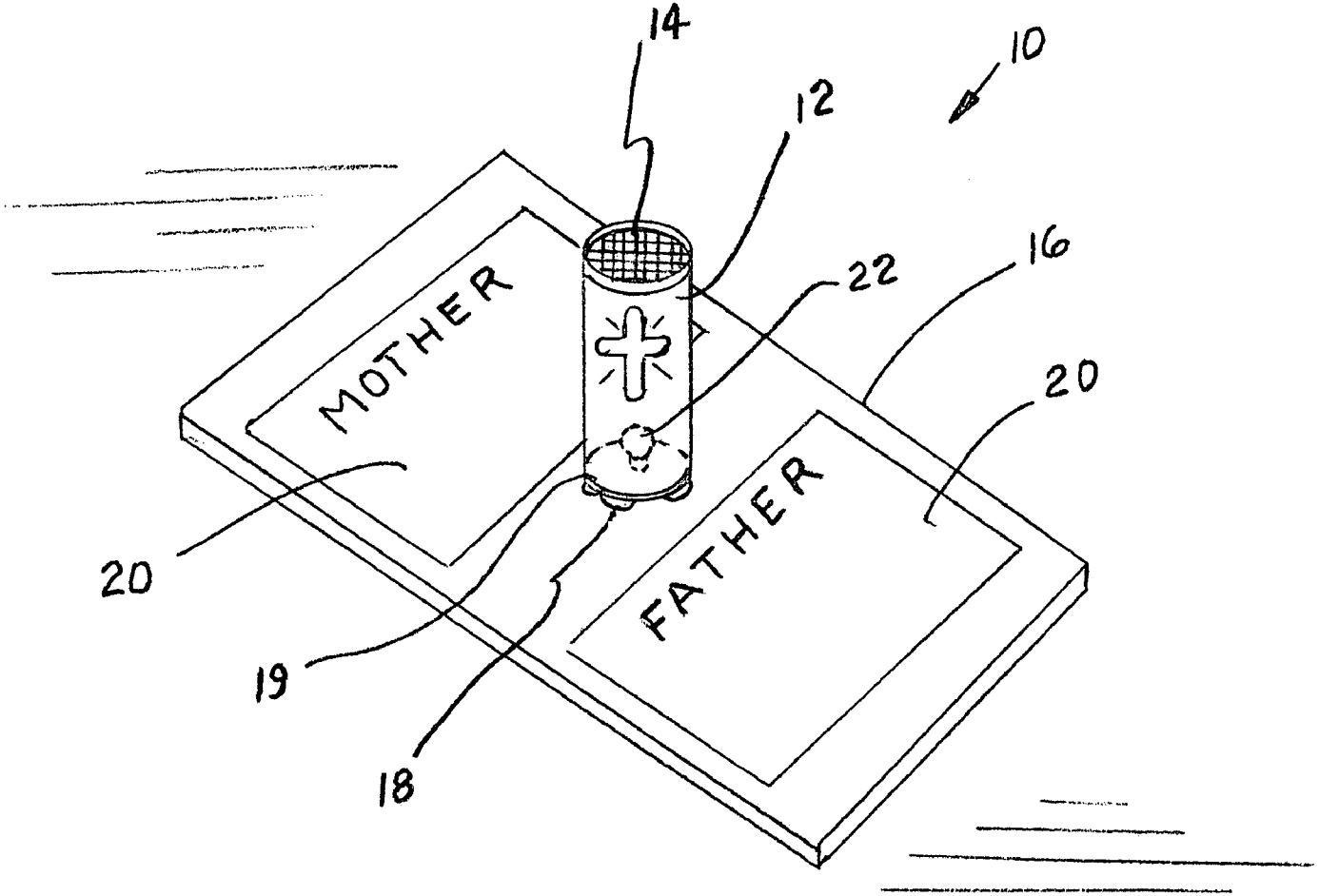
FIG. 1 is a perspective view of the apparatus on a flat memorial.

BRIEF DESCRIPTION OF A PRESENTLY PREFERRED AND VARIOUS ALTERNATIVE EMBODIMENTS OF THE INVENTION

Prior to proceeding to the more detailed description of the present invention it should be noted that, for the sake of clarity and understanding, identical components which have identical functions have been identified with identical reference numerals throughout the several views illustrated in the drawing figures.

Referring initially to FIG. 1, the apparatus 10 is shown in place on a ground-flush gravesite memorial 16 between brass plaques 20. An illuminated form 12, such as an electric votive candle, has a solar panel 14 on top which uses sunlight to recharge batteries in the base 19. These batteries within base 19 power the light bulb 22 mounted on the top surface of base 19. Attachment means 18 holds the base 19 tightly to the marble slab of memorial 16.

Figure 2:
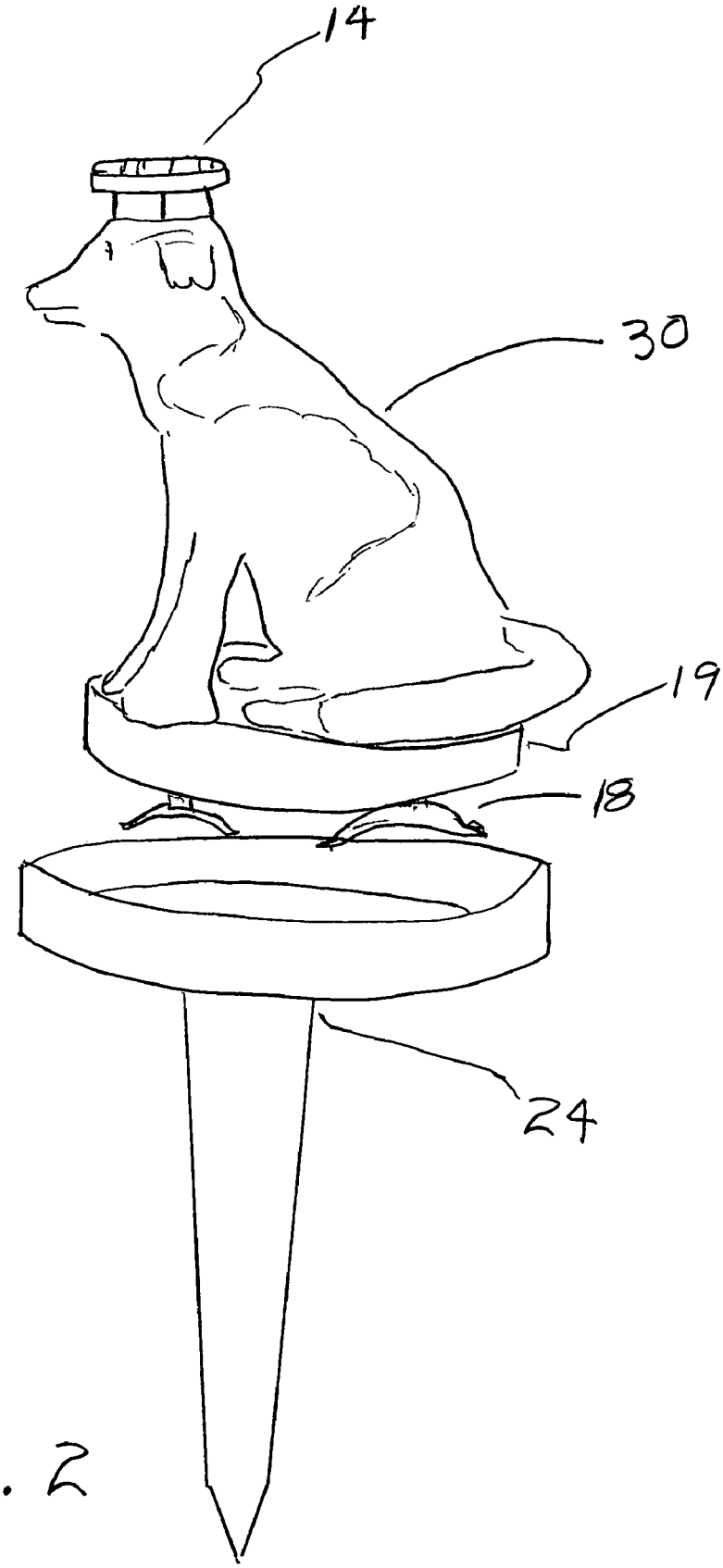
FIG. 2 displays the invention in the form a lighted animal figurine attachable to a ground stake.

In FIG. 2, the invention is shown adapted into the form of a pet for either a pet's gravesite or for the gravesite of a pet lover. The animal figurine 30 sits on a base 19 with suction cups 18 on the bottom of, base 19, which also houses the battery and circuitry not shown. Photovoltaic cells 14 are mounted on top of figurine 30, to resemble a halo, and the suction cups 18 hold the unit to a ground stake 24 in this case.

Figure 3:
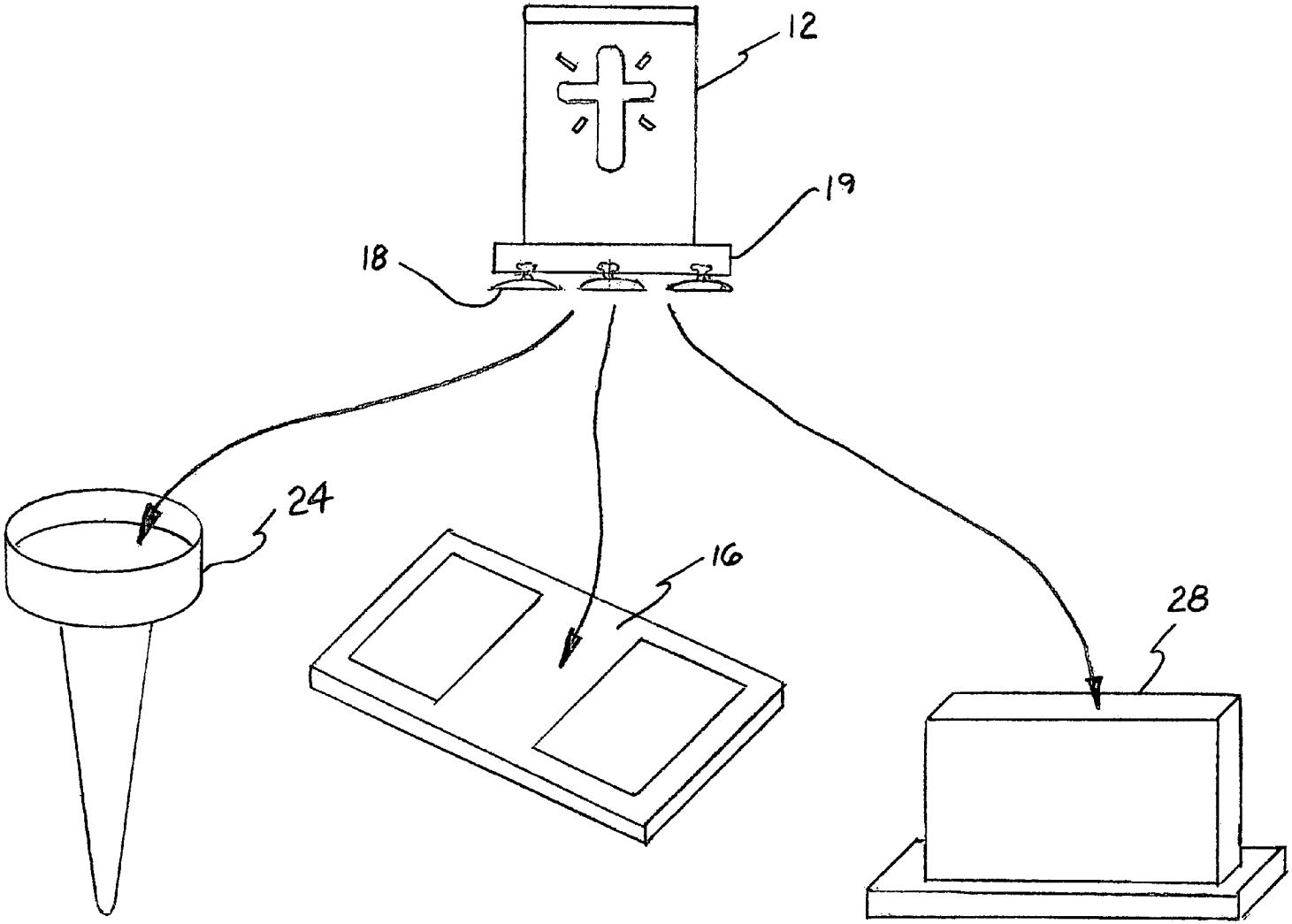
FIG. 3 provides perspective views illustrating the versatility of the attachment means for installation of one illuminated device three different ways.

In FIG. 3, the versatility of the attachment means is illustrated. One or more suction cups 18 are attached to the base 19 of illuminated form 12, typically by pushing knobs on the apices into tight-fitting holes in the base 19.

Figure 4:
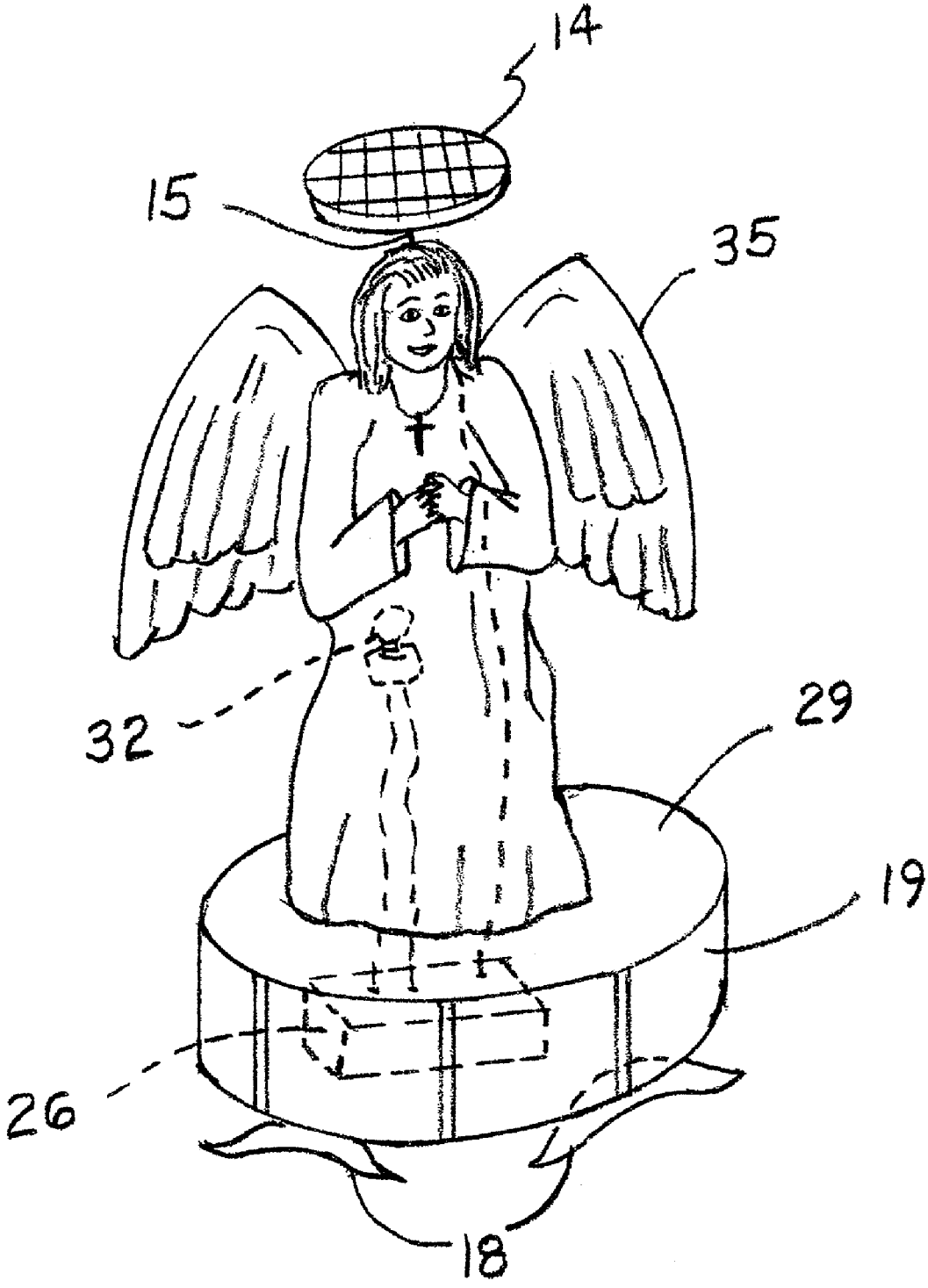
FIG. 4 is a perspective view of the apparatus utilizing a reflective base with the versatile attachment means.

FIG. 4 depicts an aspect of the invention applicable to deceased people or for the gravesites of pets. An angel or animal figurine 30 is attached to a base 19 which has a reflective coating 29 on the top surface of base 19. The reflective coating augments illumination by the sun during the day and by the internal light at night. The attachment means 18 are located horizontally disposed on the bottom surface of base 19. A solar panel 14 of photovoltaic cells is mounted atop figurine 30 with elongated and vertical minimally visible attachment means 15 so as to hover like a halo, and the solar panel 14 is wired to compartment 26 housing electrical circuitry including rechargeable batteries. A light bulb 32 is housed within figurine 30 and wired to the electrical compartment 26.

While a presently preferred and various alternative embodiments of the present invention have been described in sufficient detail above to enable a person skilled in the relevant art to make and use the same, it should be obvious that various other adaptations and modifications can be envisioned by those persons skilled in such art without departing from either the spirit of the invention or the scope of the appended claims.

I claim:

1. An illuminated gravesite marker assembly comprising:

a) a squat opaque base having substantially parallel flat top and bottom faces;

b) electrical circuitry electrically connected to at least one rechargeable battery for powering at least one low voltage light bulb, wherein said at least one rechargeable battery is removably disposed within said squat opaque base;

c) a preselected translucent hollow form made of a predetermined material housing said at least one low voltage light bulb;

d) at least one photovoltaic cell mounted on an upper outer portion of said translucent hollow form, said at least one photovoltaic cell being electrically connected to said electrical circuitry; and e) an attachment means on said bottom face of said squat opaque base for mounting said illuminated gravesite marker assembly on one of a ground stake, an upright burial memorial, and a ground-flush burial memorial, wherein said attachment means is at least one horizontally disposed suction cup made of a predetermined flexible material.

2. The apparatus, according to claim 1, wherein said predetermined material is a thermoplastic.

3. The attachment means, according to claim 1, wherein said predetermined flexible material is a plasticized polyvinylchloride polymer.

4. The apparatus, according to claim 1, wherein said preselected form is one of a votive candle, an angel, and an animal.

5. An illuminated gravesite marker assembly for cemeteries comprising:

a) a squat opaque base having substantially parallel flat top and bottom faces;

b) electrical circuitry electrically connected to at least one rechargeable battery for powering at least one low voltage light bulb, wherein said at least one rechargeable battery is removably disposed within said squat opaque base;

c) a translucent hollow figurine made of a predetermined material housing said at least one low voltage light bulb;

d) at least one photovoltaic cell mounted on an upper outer portion of said translucent hollow figurine, said at least one photovoltaic cell being electrically connected to said electrical circuitry;

e) a first attachment means horizontally disposed on said bottom face of said squat opaque base for mounting said illuminated gravesite marker assembly on one of a ground stake, an upright burial memorial, and a ground-flush burial memorial;

f) a reflective coating on said top face of said squat opaque base; and g) a second attachment means for holding said at least one photovoltaic cell on top of said translucent hollow figurine comprising at least one elongated vertical leg, wherein an end of said at least one elongated vertical leg extends from a top of said translucent hollow figurine and connects an off-centered portion proximate to a bottom edge of said photovoltaic cell to create a resemblance of a halo.

6. The attachment means, according to claim 5, wherein said preselected translucent hollow figurine is one of an angel and an animal.

* * * * *